United States Patent [19]

Kritzer

[11] 4,332,069

[45] Jun. 1, 1982

[54] MAKING HEAT EXCHANGERS

[76] Inventor: Richard W. Kritzer, 400 E. Randolph, Chicago, Ill. 60601

[21] Appl. No.: 205,795

[22] Filed: Nov. 10, 1980

[51] Int. Cl.[3] ..... B21D 53/02; B23P 15/26

[52] U.S. Cl. ..... 29/157.3 A; 29/727; 29/157.3 B

[58] Field of Search ..... 29/157.3 A, 157.3 B, 29/157.3 C, 727, 157.3 R; 113/118 A, 118 B

[56] References Cited

U.S. PATENT DOCUMENTS 3,776,018 12/1973 French ..... 29/157.3 A
3,781,959 1/1974 O'Connor ..... 29/157.3 B
3,791,003 2/1974 Pasternak ..... 29/157.3 A
3,886,639 6/1975 Pasternak ..... 29/157.3 A

*Primary Examiner*—Lowell A. Larson
*Assistant Examiner*—V. K. Rising
*Attorney, Agent, or Firm*—Emrich, Lee, Brown & Hill

[57] ABSTRACT

The method of making elongated heat exchangers having outwardly projecting fins spaced longitudinally thereof, wherein the fins are cut or gouged from a surface of a work-piece, and which method includes making indentations in the surface prior to cutting or gouging the fins therefrom, to thereby afford roughened surfaces of the fins so formed, and which method may also include scratching or cutting a surface of a previously formed fin.

8 Claims, 7 Drawing Figures

FIG. 1
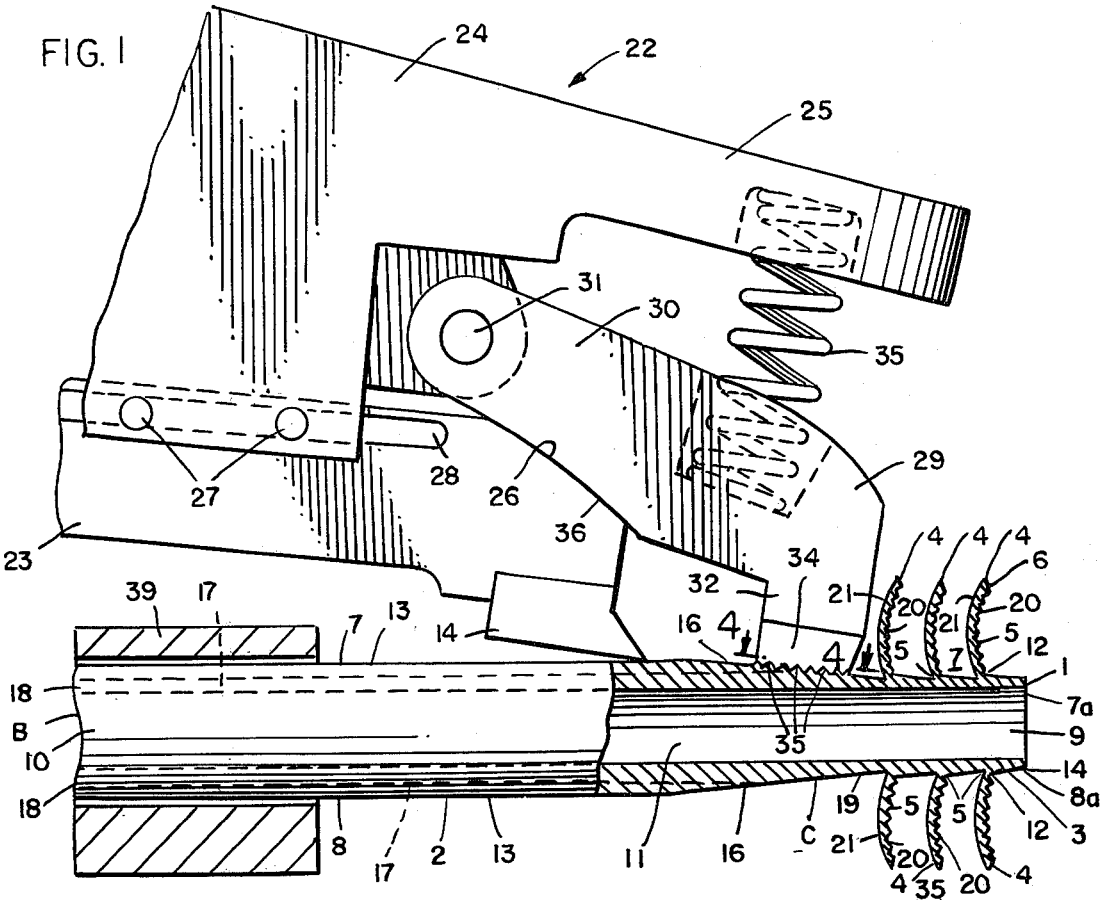
FIG. 2
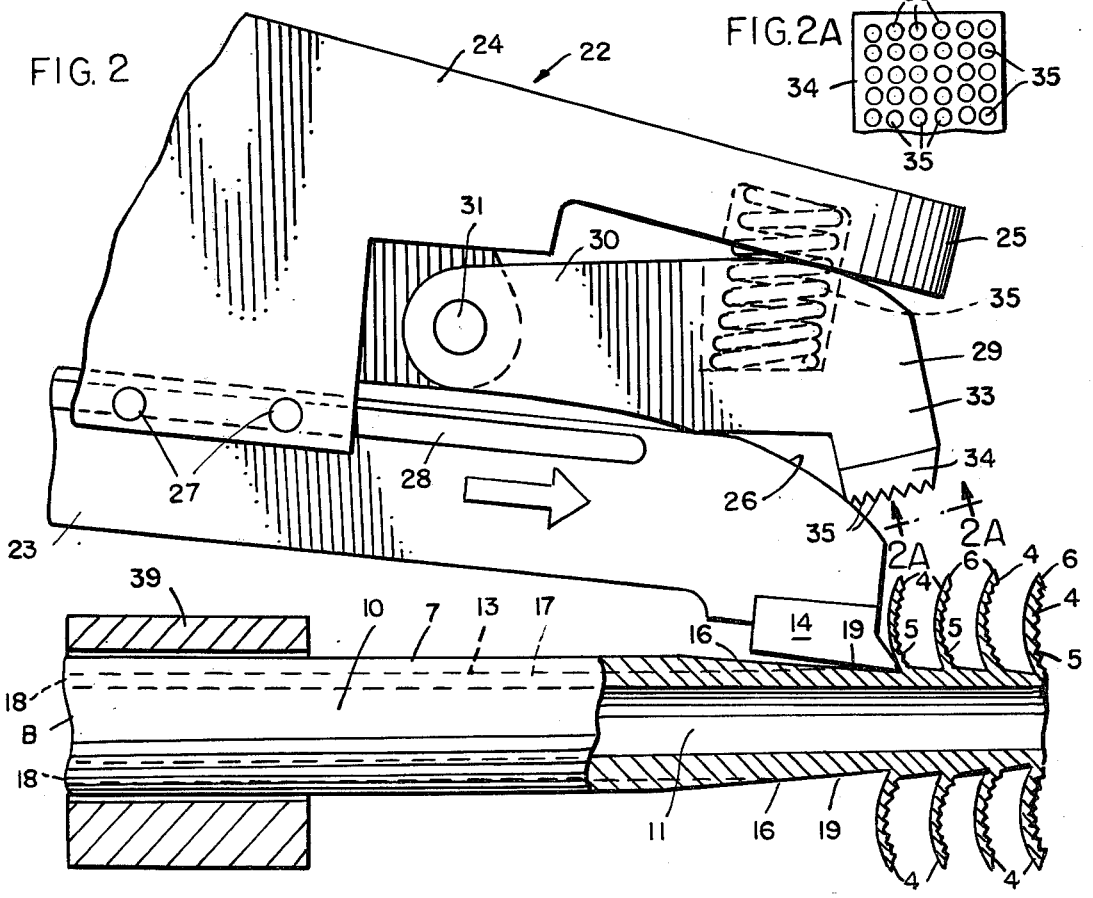
FIG. 2A

FIG. 6
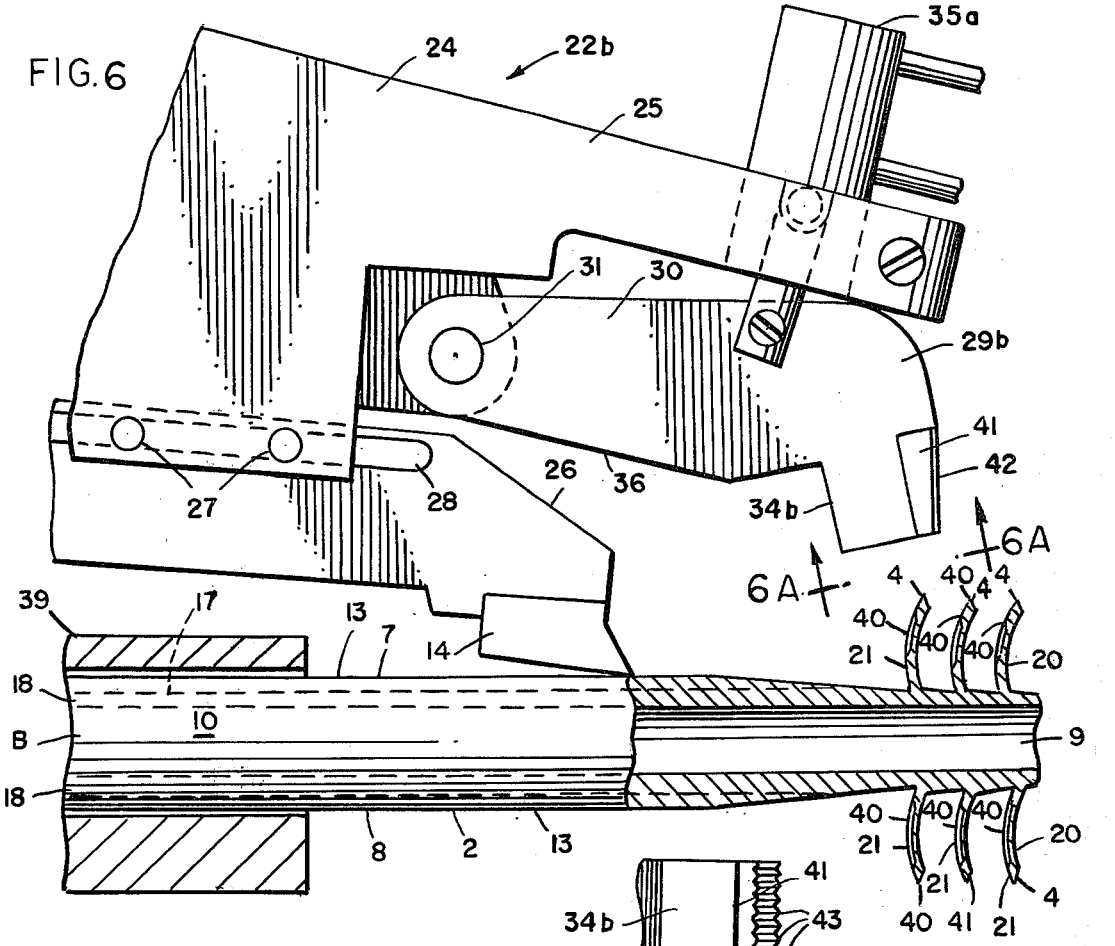
FIG. 6A
FIG. 7
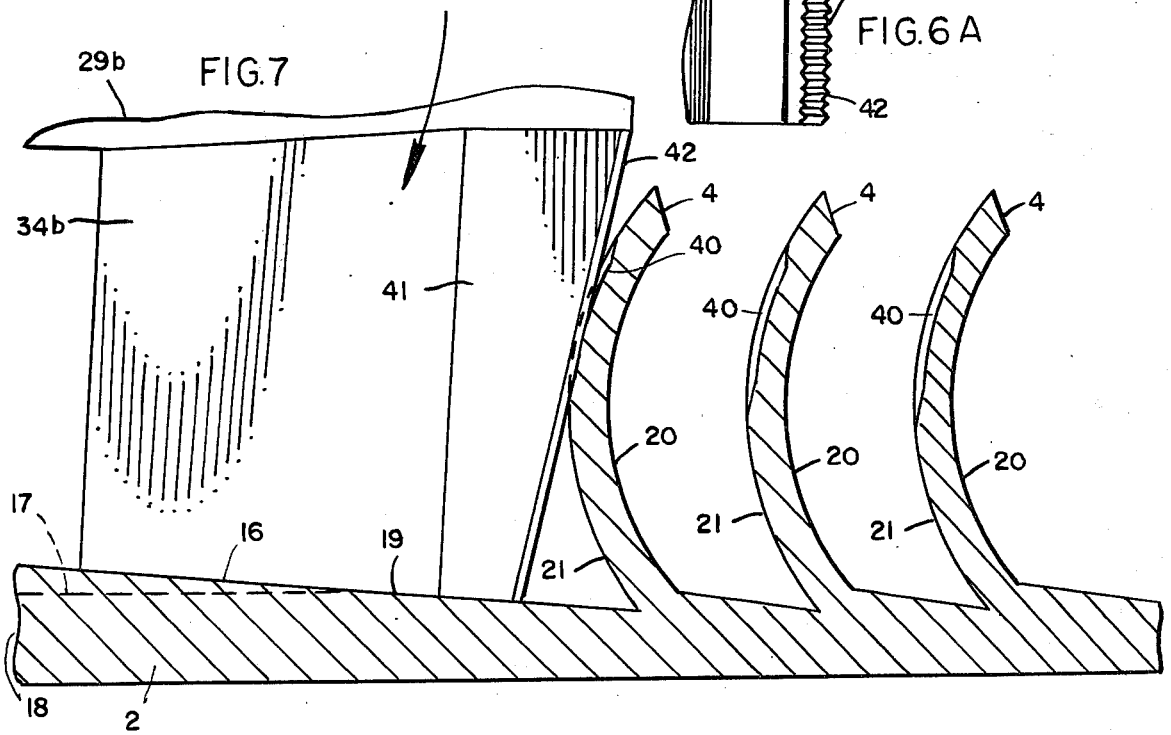

MAKING HEAT EXCHANGERS

BACKGROUND OF THE INVENTION

This invention relates to methods of making heat exchangers, and, more particularly, to methods of making heat exchangers having outwardly projecting fins spaced longitudinally therealong, and wherein the faces of the fins have roughened surfaces.

It is a primary object of the present invention to afford a novel method of making a heat exchanger.

Another object is to afford a novel method of making a heat exchanger wherein external fins are formed by cutting or gouging the same from wall portions of the heat exchanger.

The making of finned heat exchangers by cutting or gouging the fins from surfaces on tubular members has been heretofore known in the art. For example, the making of spined heat exchangers by cutting or gouging the spines from outwardly projecting ribs on a tubular member has been heretofore known in the art, being shown, for example, in my earlier U.S. Pat. No. 3,202,212, issued Aug. 24, 1965; and in U.S. Pat. Nos. 3,866,286, issued to Stephen F. Pasternak on Feb. 18, 1975; 3,886,639, issued to Stephen F. Pasternak on June 3, 1975; and 3,947,941, issued to Joseph M. O'Connor, on Apr. 6, 1976.

Also, the making of finned heat exchangers wherein spines are formed as integral parts of a larger fin member by cutting or gouging the spines from outwardly projecting ribs and cutting or gouging the remainder of the fin members from material underlying the ribs has been heretofore known in the art, being shown, for example in U.S. Pat. No. 3,692,105, issued to Joseph M. O'Connor, on Sept. 19, 1972, and in my co-pending applications for U. S. Pat., Ser. No. 198,458, filed Oct. 20, 1980, and Ser. No. 204,210, filed Nov. 5, 1980.

It is an important object of the present invention to afford a novel method of forming finned and/or spined heat exchangers.

It is known that in the making of finned and/or spined heat exchangers in accordance with the teachings of all of the aforementioned patents and the aforementioned patent applications, the faces of the fins, facing in the direction of the travel of the cutting tool in the making of the cut, are substantially roughened. Such roughening commonly is in the nature of bubbles having a thickness of 0.001 to 0.002" on fins having an over-all thickness of 0.009". This, in spite of the face that the reverse sides of such fins and the underlying surfaces of the work-piece, from which the fins have been cut or gouged, are shiny smooth in nature. It is my opinion that such roughening of the one side of such fins is caused by the thickening and fore-shortening of the fins during the gouging action—cuts of substantially less thickness (such as 0.003") and of greater length (such as 1.125") being used to produce fins of substantially greater thickness (such as 0.009") and lesser length (such as 0.4").

It has been found that even having the one roughened surface on such fins, as those disclosed in the aforementioned patents, is advantageous in a heat transfer member, affording a greater heat transfer surface area; assisting in breaking up laminar flow past the fins; creating turbulence in the working fluid passing between the fins; and tending to break up the boundary layers of working fluid disposed immediately adjacent to such roughened surfaces.

It is an important object of the present invention to increase such advantageous performances of heat transfer members by increasing the roughening of the cutter-remote sides of such fins in a novel and expeditious manner.

It is another object of the present invention to increase such advantageous performances of heat transfer members by enabling, if desired, both sides of such fins to be roughened in a novel and expeditious manner.

Another object of the present invention is to afford a novel method of making finned and/or spined heat exchangers wherein, at least, the aforementioned increased roughening of the cutter-remote sides of the fins is brought about by perforations being formed in the aforementioned tubular surfaces, just prior to the fins being cut or gouged from such surfaces.

Methods of making heat exchangers wherein openings or indentations were formed in the aforementioned surfaces of heat exchangers, prior to fins and/or spines being cut or gouged from such surfaces have been heretofore known in the art, being shown, for example, in U.S. Pat. No. 3,901,312, issued to Stephen F. Pasternak, on Aug. 26, 1975, and wherein openings, extending through the aforementioned surfaces in a direction longitudinal to such heat exchangers, were formed prior to the cutting or gouging of fins from those surfaces; and U.S. Pat. No. 3,947,941, issued to Joseph M. O'Connor and Stephen F. Pasternak on Apr. 6, 1976, wherein openings or depressions were formed in the ribs of a ribbed heat exchanger by toothed rollers, during the longitudinal feeding of the work-piece prior to the cutting or gouging of the fins and/or spines.

It is an important object of the present invention to afford a novel method of making finned and/or spined heat exchangers, having openings through the fins and/or spines, and which method is distinguished from and patentable over the methods taught by the last mentioned patents.

Another object of the present invention is to afford a novel method of making finned and/or spined heat exchangers of the aforementioned type, wherein the surfaces from which the fins and/or spines are cut or gouged, are formed in a novel and expeditious manner.

An object ancillary to the foregoing is to afford a novel method of the aforementioned type, wherein the forming of the indentations is made as an individual operation with respect to the respective surfaces from which the individual fins are cut or gouged.

A further object of the present invention is to afford a novel method of making finned and/or spined heat exchangers, in the aforementioned manner, wherein the cutter-adjacent sides of the fins and/or spines are roughened in a novel and expeditious manner.

Another object of the present invention is to afford a novel method of the aforementioned type, wherein the roughening of both the cutter-remote side and the cutter-adjacent side of individual fins may be effected in a novel and expeditious manner.

Another object of the present invention is to afford a novel method of making heat exchangers which is effective to afford, in a novel and expeditious manner, increased turbulence in air or other working fluid passing across the completed heat exchanger.

Other and further objects of the present invention will be apparent from the following description and claims and are illustrated in the accompanying drawings which, by way of illustration, show preferred embodiments of the present invention and the principles thereof and what I now consider to be the best modes in which I have contemplated applying these principles. Other embodiments of the invention embodying the same or equivalent principles may be used and changes may be made as desired by those skilled in the art without departing from the present invention and the purview of the appended claims.

DESCRIPTION OF THE DRAWINGS

In the drawings:

FIG. 1 is a fragmentary, somewhat diagrammatic showing of apparatus adapted to perform the presently preferred form of my novel method;

FIG. 2 is a view similar to FIG. 1, showing the apparatus in a different operative position;

FIG. 2A is a fragmentary, bottom plan view of a portion of the apparatus, looking in the direction of the arrows 2A—2A in FIG. 2;

FIG. 6 is a view somewhat similar to FIG. 5, but showing a modified form of the apparatus for performing a modified form of the present invention, and showing the apparatus in different operative position;

FIG. 6A is a fragmentary bottom plan view of a portion of the apparatus shown in FIG. 6, looking in the direction of the arrows 6A—6A in FIG. 6; and FIG. 7 is an enlarged, fragmentary view of a portion of the apparatus shown in FIG. 6, showing the apparatus disposed in different operative position.

DESCRIPTION OF THE EMBODIMENTS SHOWN HEREIN

A method of making a heat exchanger element, together with apparatus and material for practicing the same are shown in FIGS. 1–4 of the drawings to illustrate the presently preferred method of making heat exchangers in accordance with the principles of the present invention.

As will be discussed in greater detail hereinafter, in the preferred practice of the present invention a heat exchanger element 1, FIG. 1, is formed from a suitable length of tubular stock, such as the tubular member 2, working from end portion A of the tubular member 2 toward the other end portion B thereof, and severing the heat exchanger 1 from the remainder B-C of the tubular member 2 upon completion of the forming of the desired length of heat exchanger, such as the length A-C. Preferably, the tubular member 2 is substantially rectangular in transverse cross-section.

Figure 4:
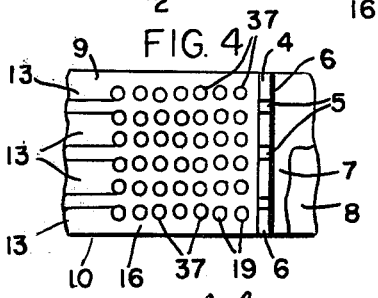
FIG. 4 is a fragmentary, top plan view of a portion of the work-piece, looking in the direction of the arrows 4—4 in FIG. 1.

The heat exchanger element 1, afforded by the aforementioned preferred form of the present method, embodies, in general, an elongated tubular body portion 3 having elongated fins 4 projecting outwardly therefrom, FIGS. 1 and 2, each of the fins 4 embodying an elongated base portion 5 having a plurality of spines 6, FIG. 4, projecting outwardly from one longitudinal edge thereof. Preferably, the fins are of the general type of the spined fins shown in the aforementioned O'Connor U.S. Pat. No. 3,692,105.

It will be remembered that the tubular member 2, shown in the drawings, is substantially rectangular in transverse cross-section, embodying a top wall 7 and a bottom wall 8, FIGS. 1 and 2, disposed in substantially parallel relation to each other, and two oppositely disposed side walls 9 and 10, FIG. 4, extending between respective sides of the side wall 7 and 8 in substantially perpendicular relation thereto. An opening 11 extends longitudinally through the tubular member 2, FIGS. 1 and 2. As will be appreciated by those skilled in the art, the tubular member 2 is shown herein as being rectangular in transverse cross-section and having a single opening 11 extending longitudinally therethrough merely by way of illustration and not by way of limitation, and tubular members having shapes other than rectangular and having a plurality of openings extending longitudinally therethrough may be afforded without departing from the purview of the present invention.

In the heat exchanger 1, shown in the drawings, the fins 4 project outwardly from the outer faces of two walls 7*a* and 8*a*, FIG. 1, corresponding to, and, in fact, formed from the walls 7 and 8 of the tubular member 2, as will be discussed in greater detail presently. The fins 4 extend longitudinally across the respective walls 7*a* and 8*a* in a direction transverse to the length of the tubular body portion 2, and each of the fins 4 embodies one of the aforementioned base portions 5 having a lower longitudinal edge portion 12 integral with the respective wall 7*a* or 8*a* to which it is attached. Each base portion 5 projects outwardly from the respective one of the walls 7*a* and 8*a*, preferably in substantially perpendicular relation thereto, with the spine 6 thereon spaced along and projecting outwardly from the longitudinal edge of the base portion 5 remote from the wall 7*a* or 8*a*.

The tubular member 2, from which the heat exchanger 1, shown in the drawings, is made, may be made of any suitable material, such as, for example, aluminum, and embodies a plurality of elongated outwardly projecting ribs 13, FIG. 4, on the outer face of each of the side walls 7 and 8, the ribs 13 extending longitudinally of the tubular member 2 in parallel spaced relation to each other.

In making the heat exchanger 1, a tubular member, such as the tubular member 2 and embodying the ribs 13 extending the full length thereof, may first be formed. Thereafter, the fins 4 may be successively formed on each of the side walls 7 and 8 from one end portion of the tubular member 2, such as the end portion A, toward the other end B thereof, FIG. 1. The fins may each be cut or gouged from the walls 7 and 8 in a suitable manner, such as that disclosed in my aforementioned co-pending patent applications Ser. Nos. and by means of suitable cutting tools, such as the cutting tool 14, FIGS. 1 and 2, which tools first cut along lengthwise, to the right, as viewed in FIG. 1, of the ribs 13 disposed on the respective opposite sides of the tubular member 2, to form the surfaces 16 which terminate at their lower ends, as viewed in FIG. 1, at the base 17 of the ribs 13, the cutting tools then continuing to cut along lengthwise the portion 18 of the wall 7 or 8 to form the surface 19, FIG. 1. The fins 4, which have been cut or gouged from the wall 7 and 8 of the body portion 2, are then bent outwardly, by the respective cutter 14, preferably to a position approximately perpendicular to the planes of the walls 7 or 8 on which they are formed.

After thus forming the fins 4 along the desired length of the tubular member 2, such as the aforementioned length A-C, the tubular member 2 may be severed transversely to its length at the point C to thereby afford a finished heat exchanger element having fins 4 spaced along substantially the full length thereof. As will be appreciated by those skilled in the art, if desired, the formation of the fins 4 may be commenced inwardly of the end portion A of the tubular member 2, and the tubular member may be severed outwardly to the left, as viewed in FIG. 1, of the last formed fin 4 to thereby afford end portions which project outwardly from the outermost fins 4 to afford connecting members at each end of the finished heat exchanger. In such last mentioned construction, not shown, the ribs 13 of the tubular member 2 disposed outwardly of the aforementioned outermost fins, preferably are removed by suitable means, such as, for example, grinding, to thereby afford a smooth-walled end portion for the completed heat exchanger.

The method of making finned heat exchangers, thus far described herein, by cutting or gouging them from the opposite sides of a tubular member, has been heretofore known in the art, being shown, for example, in the previously mentioned patents and in the previously mentioned co-pending patent applications.

It will be remembered that it has been heretofore known that when fins are made in the aformentioned manner, by cutting or gouging them from opposite sides of a smooth-walled tubular member, the faces of the fins of such heretofore known heat exchangers, corresponding to the sides or faces 20 of the fins 4, which face to the right, as viewed in FIG. 1, in the direction of the cutting movement of the cutters, such as the cutter 14, only, are roughened, while the faces of the fins, corresponding to the faces 21 of the fins 4, shown in FIG. 1, facing to the left are shiny smooth, as are the surfaces of the tubular member 2 from which these last mentioned faces are lifted. It will be remembered that one of the major purposes of the present invention is to increase the roughness of the faces 20 of the fins 4 over that of the corresponding faces of fins heretofore known in the art, to thereby afford the previously mentioned advantageous performances of the fins 4.

In accordance with the principles of the preferred form of my present invention, the increased roughening of the faces or sides 20 of the fins 4 is accomplished by forming perforations in the surfaces 16 and 19 of the tubular member 2, from which each fin 4 is cut or gouged, just prior to the formation of the respective fin 4.

In FIGS. 1-2 of the drawings, apparatus, which is suitable for the practice of the preferred form of my invention is fragmentarily shown in operable position relative to the upper side of the tubular member 2, to illustrate a manner in which the invention may be practiced. As will be appreciated by those skilled in the art, although such apparatus is shown in operation only on the upper side of the tubular member 2, it is to be understood that similar apparatus would be simultaneously used on the underside of the tubular member 2, in forming a heat exchanger, such as the heat exchanger 1, shown in the drawings, wherein the fins 4 are formed both on the top and the bottom of a tubular member, the showing of only one such apparatus being sufficient for disclosure of the practice of the method with which we are herein concerned.

The apparatus 22, fragmentarily shown in FIGS. 1 and 2, may be of any suitable type, but, preferably, is of the general type shown in my aforementioned co-pending U.S. patent applications Ser. Nos. 198,458 and 204,210, and embodies an elongated, substantially rectangular-shaped cutter slide 23 slidably mounted in the bottom portion of a substantially inverted U-shaped stationarily mounted cutter guide 24. The slide 23 and the guide 24 preferably are of the same type, and operate in the same manner as the slide and guide shown in my aforementioned co-pending U.S. patent application Ser. No. 198,458, except that the guide 24 has a tongue 25 projecting forwardly from the upper portion thereof in overlying relation to the path of reciprocation of the front end of the slide 23, and the slide 23 has a cam surface 26 on the upper, front end portion thereof for a purpose which will be discussed in greater detail presently.

As in the apparatus shown in the aforementioned co-pending U.S. patent applications Ser. Nos. 198,458 and 204,210, the slide 23 is slidably mounted in the guide 24 by pins 27 mounted in the guide 24 and operatively engaged in elongated slots disposed on opposite sides of the slide 23, in the manner of the slot 28 shown in FIGS. 1 and 2, the slide 23 being movable, during operation of the apparatus 22, from a fully retracted position, as shown in FIG. 1, to a fully extended position, as shown in FIG. 2, by any suitable mechanism, not shown, such as the mechanism shown in the aforementioned co-pending patent applications.

The apparatus 22 also embodies an elongated, substantially L-shaped lever arm 29 disposed in underlying relation to the tongue 25, with the free end of the longer leg 30 thereof pivotally mounted to the guide 24 by suitable means such as a pin 31, and with the free end of the shorter leg 32 of the lever arm 29 facing toward the tubular member 2. The lever arm 29 forms the base portion of a marker mechanism 33, which includes a marking tool 34, mounted on the free end portion of the leg 32, and a compression spring 35 disposed in operative position between the tongue 25 and the upper portion of the leg 30 of the lever arm 29 in position to yieldingly urge the lever 29 to pivot downwardly around the pin 31, in a clockwise direction, as viewed in FIGS. 1 and 2, toward the tubular member 2.

The marker tool 34 is disposed in underlying relation to the lower face of the free end of the shorter leg 32 of the lever arm 29 and has a plurality of perforating members 35, FIGS. 1, 2 and 2A, which preferably are conical in shape projecting downwardly from the lower face thereof with the points of the cone-shaped members 35 projecting in an outward direction.

The lever arm 29 has a cam surface 36 on the lower face of the longer leg 30 thereof, and is of such size and is so disposed on the guide 24 that the surface 26 on the lever arm 29 rides along the surface 36 of the slide 23, under the urging of the compression spring 35, during the reciprocation of the slide 23 between the fully retracted position, shown in FIG. 1, and the fully extended position shown in FIG. 2, to thereby cause the lever arm 29 to oscillate around the pin 31 between the fully lowered position, shown in FIG. 1 and the fully raised position, shown in FIG. 2. When the lever arm 29 is disposed in the fully lowered position shown in FIG. 1, the pins 35 are effective to perforate the portions of the tube 2 underlying the surfaces 16 and 19 into the base 18, underlying the ribs 13, but not to a depth sufficient to perforate the tubular member 2. For example, with a tubular member 2 having a wall thickness of 0.035", and with the depth of cut being 0.003", it is preferred that the length of the pins 35 be such that the marker member 34 does not cause perforating of the tubular member 2 beyond a tube thickness of less that 0.030" from the interior of the tube wall.

From the foregoing it will be seen that in the apparatus 22, suitable drive mechanism, not shown, is effective to reciprocate the slide 23 longitudinally through the guide 24 between the fully retracted position shown in FIG. 1 and the fully extended position shown in FIG. 2, and thus correspondingly reciprocate the cutter 14 through the cutting or gouging motions, heretofore mentioned, for forming fins, such as the fins 4.

During such movement of the slide 23 from the fully retracted position shown in FIG. 2 to the fully extended position shown in FIG. 2, the engagement between the cam surfaces 26 and 36 is effective to swing the lever arm 29 upwardly, in a counter-clockwise direction against the urging of the spring 35 to thereby raise the marker tool 35 upwardly out of engagement with the tubular member 2. This forward movement of the slide 23 is effective to move the cutter 14 forwardly through the cutting or gouging operation, previously mentioned, and to raise an additional fin 4 into substantially upright position, as shown in FIG. 2.

Figure 3:
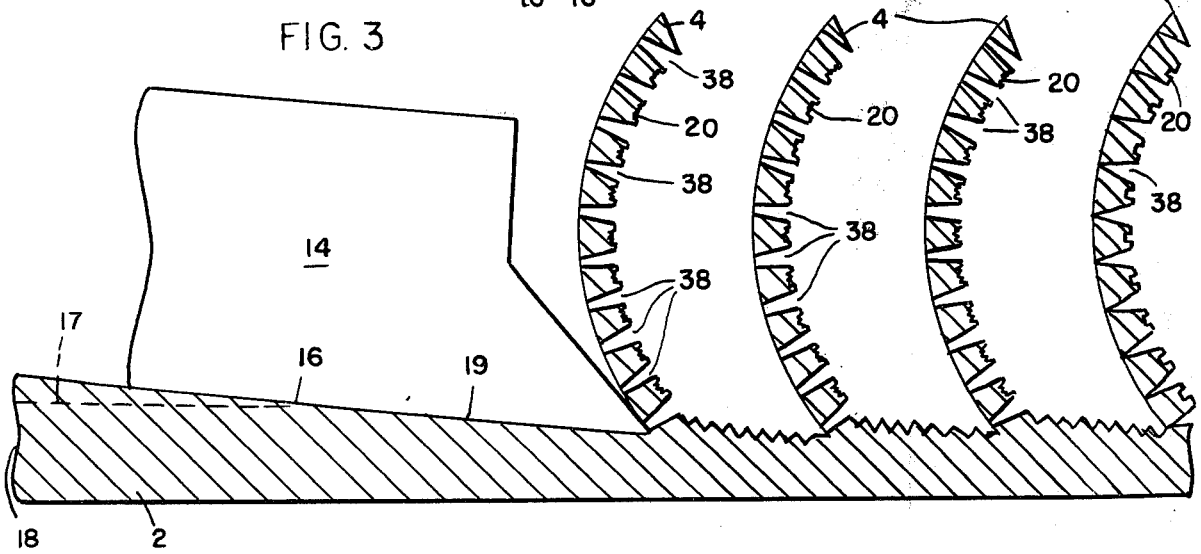
FIG. 3 is an enlarged, fragmentary view of a portion of FIG. 2.

Thereafter, during reciprocation of the slide 23 back into fully retracted position, the spring 35 is effective to swing the lever arm 29 downwardly, in a clockwise direction, as viewed in FIGS. 1 and 2, from the position shown in FIG. 2 to the position shown in FIG. 1, wherein the pins 35 on the marker 34 are effective to form perforations, such as the perforations 37, FIG. 4, in the surfaces 16 and 19 just formed by the cutter 14 on the tubular membef 2. Thus, when the slide 23 again moves forwardly through a cutting or gouging operation, the cutter 14 cuts a slice through the now perforated surfaces 16 and 19, so that the fin 4 which is turned upwardly has openings 38, FIG. 3, extending therethrough. It will be remembered that in the preferred practice of the present invention, the perforations 37 formed in the surfaces 16 and 19 are longer than the depth of cuts for the fins 4. Thus, the openings 38 through the fins 4 are substantially frusto-conical in form, as shown in FIG. 3.

The machine or apparatus, of which the apparatus 22 forms a part, also includes a guide 39, FIGS. 1 and 2, for a tubular member, such as the tubular member 2, for longitudinal movement of the tubular member 2 therethrough. The guide is disposed in position to effectively support the tubular member 2 in position for the aforementioned cutting or gouging operations of the cutters, such as the cutter 14, on the tubular member 2.

As will be appreciated by those skilled in the art, in the performance of the above described method, apparatus, similar to the apparatus 22 will also be disposed below the tubular member 2, as viewed in FIGS. 1 and 2, and will operate simultaneously with the apparatus 22 shown in the drawings, so that the impacting forces and the cutting and gouging forces on the tubular member 2 are balanced.

From the foregoing, it will be seen that, with fins formed in accordance with the practice of the aforementioned method, not only are the faces 20 of the fins 4 roughened by reason of the fore-shortening of the fins during the formation of the same, but this roughening is increased by reason of the openings 38 formed in the fins 4.

As will be appreciated by those skilled in the art, actuators other than the compression spring 35, shown in FIGS. 1 and 2, may be embodied in the apparatus 22 for moving the marker member 34 into perforation-forming position, without departing from the purview of the present invention. As an example of this, apparatus **22*a* is shown in FIG. 5, which is identical in construction and operation to the apparatus 22 shown in FIGS. 1–4, except that a mechanical actuator 35*a*, which may be of any suitable type, such as, for example, an electro-air device or a hydraulically actuated device, has been substituted for the compression spring 35 for moving the lever arm 39 into marker impacting position, such as the position of the marker 34 shown in FIGS. 1 and 5**.

From the foregoing it will be seen that the hereinbefore described method, which is illustrated in FIGS. 1–5, affords a novel method of making heat exchangers wherein the roughening of the cutter-remote sides of the fins thereon is increased in a novel and expeditious manner.

In FIGS. 6 and 7, apparatus **22*b* is shown for performing a modified form of the present invention. In this modified form of the present invention, not only are the faces 20 of the fins 4 roughened in the previously described manner, but the faces 21 of the fins 4 are also roughened by having elongated scratches or grooves 40 formed therein, FIGS. 6 and 7**, as will be discussed in greater detail presently.

Figure 5:
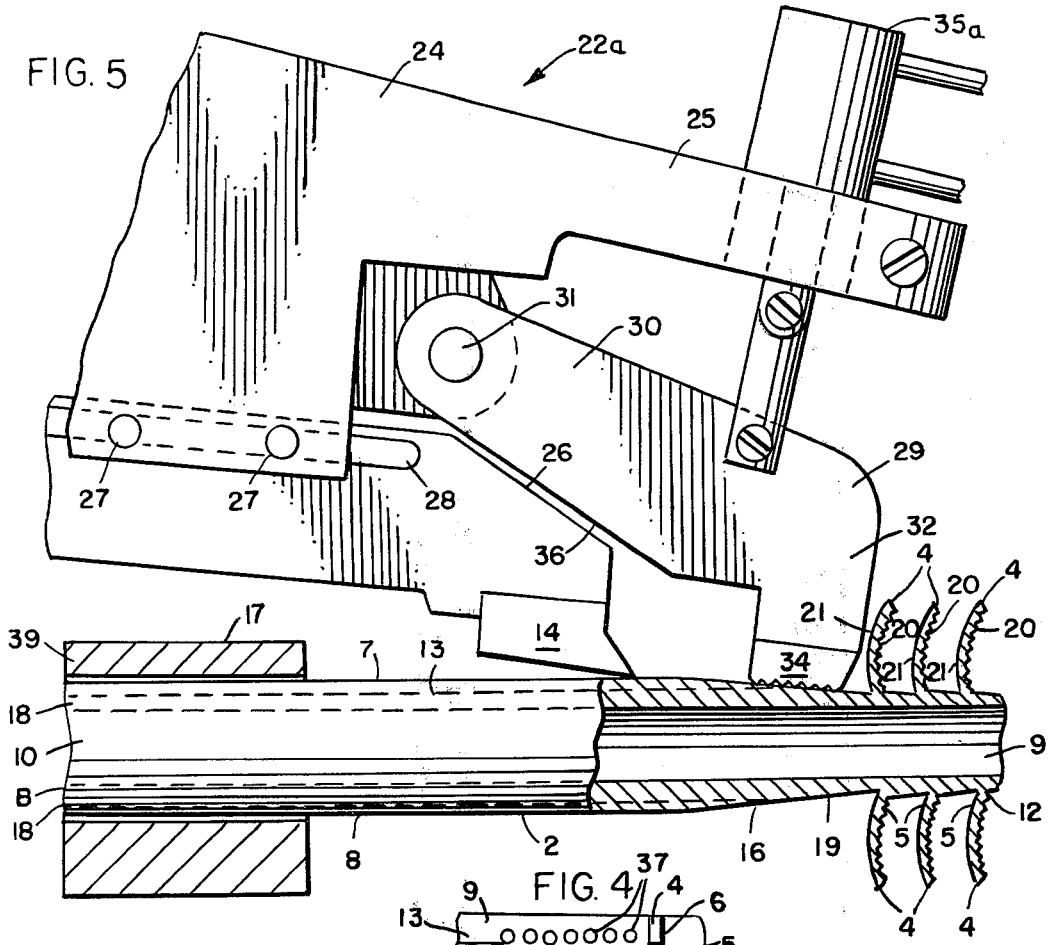
FIG. 5 is a view similar to FIG. 1, but showing a modified form of the apparatus adapted to perform the presently preferred form of my novel method.

The apparatus **22*b*, shown in FIGS. 6 and 7, is identical in construction to the apparatus 22*a* shown in FIG. 5, except that the lever arm 29*b* has been modified so that the marker member 34*b* thereon embodies a cutter member 41 disposed on the face thereof, remote from the pin 31, with the cutter member 41 having a serrated edge 42, FIGS. 6 and 6*a*, disposed in position to engage the face of the immediately previously formed fin 4 during each downward movement of the marker member 34*b* into position to perforate the surfaces 16 and 19 on the tubular member 2, FIG. 7. The serrations 43 on the serrated edge 42, preferably are disposed thereon in substantially upright, parallel spaced relation thereacross, FIG. 6*a*, in position to form the aforementioned scratches or grooves 40 on the faces 21 of the fins 4** in parallel spaced relation to each other across the full width of the latter.

It will be seen that in the practice of the modified form of the present invention, illustrated in FIGS. 6, **6*a*, and 7, not only are the front faces 20 of the fins 4 roughened, but the rear faces 21** are also roughened during the formation of the fins.

From the foregoing it will be seen that the present invention affords a novel method of making heat exchangers.

In addition, it will be seen that the present invention affords a novel method of making heat exchangers having improved heat-transfer characteristics between the fins thereof and the working fluid passing therebetween.

In addition, it will be seen that the present invention affords a novel method of making heat exchangers which is practical and efficient in operation and which may be readily and economically accomplished.

Thus, while I have illustrated and described the preferred embodiments of my invention, it is to be understood that these are capable of variation and modification, and I therefore do not wish to be limited to the precise details set forth but desire to avail myself of such changes and alterations as fall within the purview of the following claims.

I claim:

1. The method of forming fins on the surface of a heat exchange element wherein at least one face of each fin has a roughened surface thereon, which comprises the steps of, (a) feeding an elongated tubular body member longitudinally past a cutter, (b) reciprocating said cutter forwardly and rearwardly toward and away from the surface of said element at an acute angle and cutting into said surface during the forward movement thereof in a skiving action, thereby to form an upstanding fin, one side of which is integral with said body, and (c) forming a plurality of indentations in the surface of said body in the area from which the next succeeding fin is to be cut, during the rearward movement of said cutter, whereby, (d) when the cutter moves forwardly for the next cut, the cutter-remote face on the fin produced thereby will have a roughened surface.

2. The method of forming fins on the surface of a heat exchange element as defined in claim 1, wherein the step of forming the identations produces indentations which have a depth greater than the thickness of the fin to be cut.

3. The method of forming fins on the surface of a heat exchange element as defined in claim 1, wherein the step of forming the identations is performed by striking a blow with a marking device having a plurality of protrusions thereon.

4. The method of forming fins on a surface of a heat exchange element as defined in claim 1, and which includes forming a roughened surface on the cutter-adjacent face of the immediately previously cut fin during the rearward movement of said cutter.

5. The method of forming fins on a surface of a heat exchange element as defined in claim 4, and in which the roughened surface on the cutter-adjacent face of the previously cut fin is in the form of elongated indentations.

6. The method of forming fins on the surface of a heat exchange element as defined in claim 5, wherein the step of forming the indentations on the cutter-remote face of a fin which is yet to be cut, and roughening the cutter-adjacent face of a previously cut fin are performed simultaneously.

7. The method of forming fins on the surface of a heat exchange element as defined in claim 6, wherein the step of simultaneously forming the indentations on the cutter-remote face of a fin which is yet to be cut, and roughening the cutter-adjacent face of a previously cut fin is performed by striking a blow with a marking device having a plurality of protrusions on two adjacent surfaces thereof.

8. The method of forming fins on the surface of a heat exchange element wherein at least one face of each fin has a roughened surface thereon, which comprises the steps of, (a) feeding an elongated tubular body member longitudinally past a cutter, (b) reciprocating said cutter forwardly and rearwardly toward and away from the surface of said element at an acute angle and cutting into said surface during the forward movement thereof in a skiving action, thereby to form an upstanding fin, one side of which is integral with said body, and (c) forming a roughened surface on the cutter-adjacent face of the previously cut fin during the rearward movement of said cutter.

* * * * *